US006500289B2

(12) United States Patent
Merker et al.

(10) Patent No.: US 6,500,289 B2
(45) **Date of Patent: *Dec. 31, 2002**

(54) METHOD OF USING WATER-BORNE EPOXIES AND URETHANES IN PRINT BONDING FLUID AND PRODUCTS MADE THEREFROM

(75) Inventors: Joseph F. Merker, Alpharetta, GA (US); Charles J. Garneski, Bothell, WA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/436,266

(22) Filed: Nov. 8, 1999

(65) Prior Publication Data

US 2002/0062911 A1 May 30, 2002

Related U.S. Application Data

(60) Provisional application No. 60/108,102, filed on Nov. 12, 1998.

(51) Int. Cl.[7] ..... B31F 1/14

(52) U.S. Cl. ..... 156/183; 156/291; 156/331.7; 156/330; 162/111

(58) Field of Search ..... 156/183, 291, 156/331.7, 330; 162/611

(56) References Cited

U.S. PATENT DOCUMENTS

| | | | | |
|---|---|---|---|---|
| 2,880,111 A | | 3/1959 | Drelich | |
| 3,059,313 A | | 10/1962 | Harmon | |
| 3,753,826 A | | 8/1973 | Plummer | |
| 3,759,775 A | | 9/1973 | Shepherd | |
| 3,879,257 A | | 4/1975 | Gentile | |
| 3,898,123 A | | 8/1975 | Phillips | |
| 3,922,418 A | | 11/1975 | Lauchenauer | |
| 3,978,257 A | | 8/1976 | Ring | |
| 4,063,995 A | | 12/1977 | Grossman | |
| 4,084,033 A | | 4/1978 | Drelich | |
| 4,108,819 A | * | 8/1978 | Oyamada et al. | 260/29.6 |
| 4,118,538 A | | 10/1978 | Balland | |
| 4,180,491 A | | 12/1979 | Kim | |
| 4,300,968 A | | 11/1981 | Fottinger | |
| 4,307,004 A | | 12/1981 | Schuhmacher | |
| 4,339,566 A | | 7/1982 | Rosenkranz | |
| 4,342,613 A | | 8/1982 | O'Leary | |
| 4,451,315 A | | 5/1984 | Miyazaki | |
| 4,455,187 A | | 6/1984 | Von Blucher | |
| 4,510,274 A | * | 4/1985 | Okazaki et al. | 523/411 |
| 4,529,465 A | | 7/1985 | DeWitt | |
| 5,064,492 A | | 11/1991 | Friesch | |
| 5,556,935 A | | 9/1996 | Traubel | |
| 5,656,701 A | | 8/1997 | Miyamoto | |
| 5,888,526 A | * | 3/1999 | Tsubai et al. | 424/405 |

FOREIGN PATENT DOCUMENTS

| | | |
|---|---|---|
| AU | 04650741 | 6/1973 |
| JP | 57160607 | 10/1982 |
| JP | 4065560 | 3/1992 |
| WO | WO 99/34056 | 7/1999 |
| WO | WO 99/49118 | 9/1999 |

OTHER PUBLICATIONS

PCT International Search Report dated Mar. 8, 2000 (7 pages).

* cited by examiner

*Primary Examiner*—Sam Chuan Yao
(74) *Attorney, Agent, or Firm*—Dority & Manning, P.A.

(57) ABSTRACT

Water-borne epoxies and/or water-borne urethanes are employed as a replacement for at least a portion of the bonding materials utilized in various print bonding processes. The additives may operate in conjunction with standard print bonding adhesives such as ethylene vinyl acetates to bond fibers together in a pulp-containing web. The paper-based sheet material made according to this process is also provided.

10 Claims, 2 Drawing Sheets

METHOD OF USING WATER-BORNE EPOXIES AND URETHANES IN PRINT BONDING FLUID AND PRODUCTS MADE THEREFROM

FIELD OF THE INVENTION

The present invention is based on provisional patent application Serial No. 60/108,102 filed Nov. 12, 1998, and priority is hereby claimed therefrom. The present invention is generally directed to paper-containing wiping products and various methods for producing such paper-based wiping products. More particularly, the present invention is directed to the use of water-borne epoxies and urethanes in print bonding fluids that are utilized in producing paper products.

BACKGROUND OF THE INVENTION

Disposable products made from papermaking fibers, either exclusively or in conjunction with various synthetic fibers, often serve as substitutes in both the home and in industrial shops for conventional cloth wipers and towels. Disposable paper-containing products such as wipers, baby wipers, food service wipers, feminine products, and other similar products should closely simulate cloth in both consumer perception and performance. Such products, including paper towels, industrial wipers, and other wiping products, are engineered to have as many cloth-like properties as possible.

For example, paper wiper products should exhibit good bulk, have a soft feel, have adequate strength even when wet, have good stretch characteristics, and resist tearing. These products should also be highly absorbent and be abrasion resistant.

Moreover, such products should not deteriorate in the environment in which they are used, regardless of whether they are used to absorb water or other types of liquids. In other words, in order to function as wipers to absorb liquids other than water, such products should exhibit a certain degree of solvent tensile strength. Solvent tensile strengths are machine direction and cross-machine direction strengths of a product that exist after the product has been exposed to, or wetted with, various solvents other than water. A paper wiping product that exhibits an acceptable solvent strength will generally maintain sufficient structural integrity even when wetted with a particular solvent to allow it to be used for its intended purpose of wiping and/or absorbing various liquids.

Typical solvents used for testing the solvent strength of products include methyl ethyl ketone, isopropyl alcohol, turpentine, and diesel fuel. If the wiping products retain sufficient dimensional strength after being soaked in solvents such as these, then such products are generally acceptable as heavy-duty wiper products.

In the past, many attempts have been made to enhance certain physical properties of disposable wiping products. Unfortunately, however, when steps are taken to increase one property of a wiping product, other characteristics of the product may be adversely affected. For instance, in cellulosic-based wiping products, softness is typically increased by reducing cellulosic fiber bonding within the paper product. Inhibiting fiber bonding, however, usually adversely affects the strength of the paper web.

One method that has been employed to reduce the stiff papermaking bonds is to crepe the paper from a drying surface with a doctor blade, which disrupts and breaks many of the interfiber bonds in the paper web. Other methods reduce these bonds by preventing formation of the bonds, rather than breaking them after they are formed. Examples of these other methods are chemical treatment of the papermaking fibers to reduce their interfiber bonding capacity before they are deposited on the web-forming surface, use of unrefined fibers in the slurry, inclusion into the slurry of synthetic fibers which are unable to form papermaking bonds, and use of little or no pressing of the web to remove the water from the paper web after it is deposited on the web-forming surface. This latter method reduces formation of bonds by reducing close contact of the fibers with each other during the forming process. Although these methods successfully increase the softness of paper webs, they result in a loss of strength in the web.

Attempts to restore the strength lost by reduction of papermaking bonds have included the addition to the web of bonding materials that add more strength than stiffness to the web. Such bonding materials may be added to the aqueous slurry of fibers and deposited on the web-forming surface along with the fibers. This method is commonly referred to in the industry as "saturation bonding". With this method, the bonding material can be distributed generally evenly throughout the web to avoid the harshness which may accompany concentrations of bonding material. However, this method has the disadvantage of reducing the absorbency of the web by filling the pores between the fibers with bonding material.

Another method which has been used to apply bonding material to the web is to apply the bonding material in a spaced-apart pattern to the web. This method of applying the bonding materials to the webs in various pattems, typically through the use of rollers or the like, is known in the industry as "print bonding". Printing a bonding material, or adhesive, onto webs in various patterns results in a product where binder is applied only at localized areas defined by the particular roller pattern being utilized. In products made by this method, the majority of the web surface does not contain the absorbency-reducing bonding material. Print bonding is a method to be contrasted with other bonding methods such as the above-described saturation bonding method which results in a web that is impregnated with a bonding material substantially continuously over its entire surface.

In contrast to synthetic fiber-only nonwoven webs, webs made entirely or principally from cellulosic fibers require print bonding areas to be relatively close together because such cellulosic papermaking fibers are typically very short. The fibers are generally less than one-quarter of an inch long. Thus, it has been thought that to apply sufficient bonding material in a pattern to a paper web to the degree necessary to bond each fiber into the network would result in a harsh sheet, having poor softness characteristics, particularly in the areas where the bonding material is located. Various methods have been developed to enhance the softness characteristics of sheets where the bonding material is highly concentrated. Some of these processes that have proved to be successful in producing paper towels and other wiping products are disclosed in U.S. Pat. No. 3,879,257 to Gentile, et al., which is incorporated herein by reference in its entirety. In Gentile, et al., processes are disclosed for producing soft, absorbent, fibrous webs having a laminate-like structure that are particularly well suited for use as wiping products.

The fibrous webs disclosed in Gentile, et al. are made from a fibrous web formed from an aqueous slurry of principally lignocellulosic fibers under conditions which reduce interfiber bonding. A bonding material, such as a latex elastomeric composition, is then applied to a first surface of the web in a spaced-apart pattern. In particular, the bonding material may be applied so that it covers from about 50 percent to about 60 percent of the surface area of the web. The bonding material provides strength to the web and abrasion resistance to the surface. Once applied, the bonding material may penetrate the web typically from about 10 percent to about 40 percent of the thickness of the web.

The bonding material is then similarly applied to the opposite side of the web for further providing additional strength and abrasion resistance. Once the bonding material is applied to the second side of the web, one side of the web is brought into contact with a creping surface. The web adheres to the creping surface according to the pattern to which the bonding material was applied. The web is then creped from the creping surface with a doctor blade, which disrupts the fibers within the web where the bonding material is not disposed, thereby increasing the softness, absorbency, and the bulk of the web.

In an embodiment disclosed in Gentile. et al., each side of the paper web is creped after the bonding material has been applied to the side. Gentile et al. also discusses the use of chemical debonders to treat the fibers prior to forming the web in order to further reduce interfiber bonding and to increase softness and bulk.

Various other print bonding processes are also known in the art. A common denominator among such processes is that they employ a bonding material that usually comprises a latex elastomeric material. Typically, the use of such bonding materials is one of the most costly raw materials expenditures involved in the formation of paper-containing wiping products. In fact, where two printing (or latex bonding) processes are required, as in the double-print/double crepe processes disclosed in some embodiments of Gentile et al., the costs associated with producing soft, absorbent products can be very high.

Various water-borne epoxy resins and water-borne urethane resins have been utilized in a variety of instances in the past. For example, water-borne epoxy resins have been utilized in forming packaging materials and as adhesives binders for various ink formulations. A water-based polyurethane resin was disclosed in U.S. Pat. No. 5,656,701 to Miyamoto et al. as being used either as a binder for water-based printing inks or as a water-based laminating adhesive in conjunction with various resins such as low-density polyethylene, ethylene-vinyl acetate copolymer and polypropylene. Miyamoto et al., however, only describes the use of water-based polyurethanes as laminating adhesives for various plastic films produced from materials such as polyolefins, modified polyolefins, polyesters, nylons, and polystyrenes.

The prior art, however, is deficient in demonstrating the use of water-borne epoxies or water-borne urethanes in connection with standard print bonding adhesives in the context of print bonding fibers together to form paper-containing webs. The present invention provides that teaching.

SUMMARY OF THE INVENTION

The present invention recognizes and addresses some of the foregoing drawbacks, and deficiencies of prior art constructions and methods.

The present invention may accomplish its intended results by employing water-borne epoxies and/or water-borne urethanes as a replacement for at least a portion of the bonding materials utilized in various print bonding processes. The present additive may operate in conjunction with standard print bonding adhesives such as ethylene vinyl acetates to bond fibers together in a pulp-containing web.

More specifically, the present invention may involve the formation of a cellulosic-containing web and then printing a pattern onto at least one surface of the paper-containing web with a bonding material containing water-borne epoxies and/or water borne urethanes. The other surface may, if desired, then be printed with a similar bonding material in the same or another pattern. In order to enhance the properties of the web, the web may then be pressed to a creping surface where it is dried before being creped from the creping surface with a doctor blade, or comparable creping knife, thereby resulting in a product having increased softness, absorbency, and bulk, with a high amount of strength and elasticity. If desired, a second creping process may be utilized either after application of the bonding material to the first surface or after the bonding material has been applied to both surfaces.

BRIEF DESCRIPTION OF THE DRAWINGS

A full and enabling disclosure of the present invention, including the best mode thereof, to one of ordinary skill in the art is set forth more particularly in the remainder of the specification, including reference to the accompanying figures in which.

Figure 1:
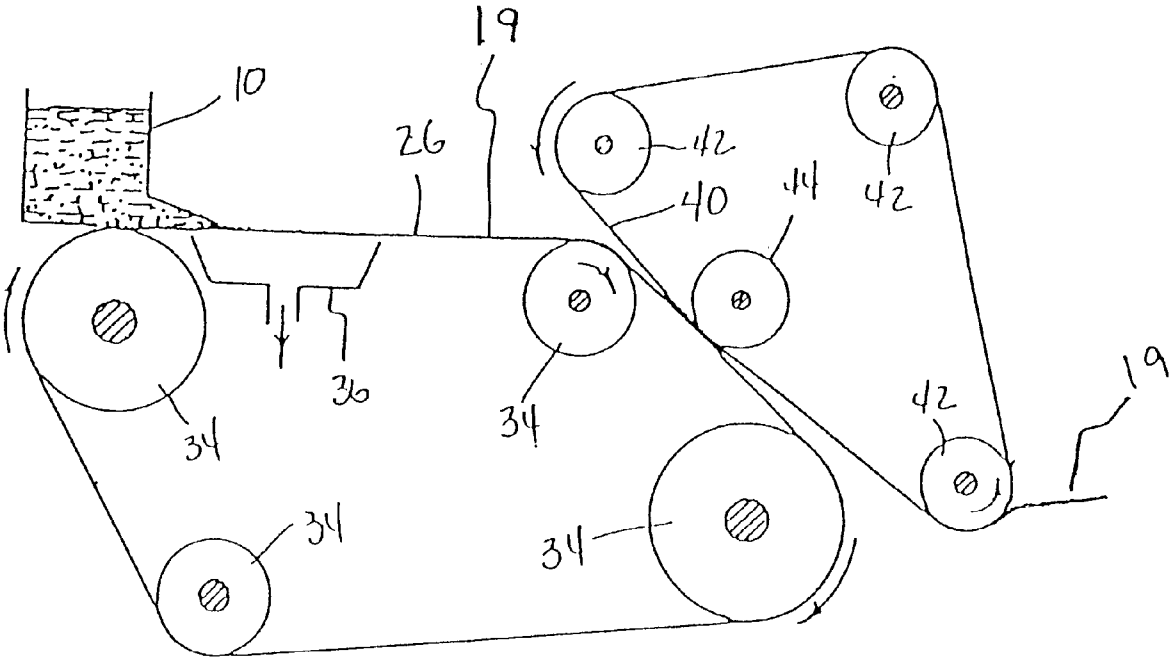
FIG. 1 is a schematic side elevation view of a paper web forming machine illustrating the formation of a paper web in accordance with the present invention.

Repeat use of reference characters in the present specification and drawings is intended to represent same or analogous features or elements of the present invention.

DETAILED DESCRIPTION OF PREFERRED EMBODIMENT

It is to be understood by one of ordinary skill in the art that the present discussion is a description of exemplary embodiments only and is not intended as limiting the broader aspects of the present invention, which broader aspects are embodied in the exemplary construction.

The present invention addresses at least some of the needs discussed above by providing a process to form a paper-containing web, and then printing or applying a bonding material that contains, in addition to a standard adhesive binder, water-borne epoxies and/or water-borne urethanes on one or both surfaces of the web. The web may also be creped either on one or both of its sides and either after each printing application or after both printing applications if both sides are print bonded.

The web may have an undulating disposition due to controlled pattern creping of the web through use of the patterned-applied bonding material as a creping adhesive. The controlled pattern creping increases the web's bulk and absorbency, as well as its softness and compressibility. It also finely crepes the areas in the surface region of the web where the bonding material is disposed and has been used to pattern adhere the web to the creping surface.

"Fine creping" as the term is used in the specification and claims, is the resulting creping effect which occurs to the portions of a web held tightly to a creping surface with adhesive. It may manifest itself in the adhesively adhered portions in greater fore-shortening and/or greater number of creping bars and/or a greater degree of softening than would have been obtained by creping of the same portions of the web without the use of adhesive. Where the fine creping is confined to a pattern on the web, it causes the creping effect on the entire web to be predominately concentrated in the areas of the web which are adhesively adhered to the creping surface and, thus, produces a patterned crepe.

The bonding material is typically disposed only part way through the web, such as to between about 10 and about 40 percent of the finished web thickness on each side, to enable the controlled pattern creping to produce maximum process improvements of bulk, softness and absorbency and to provide the most efficient use of the bonding material. In some embodiments of the web, the bonding material is disposed between about 10 and about 60 percent through the finished web product on both sides of the web but, in such embodiments, either because of the particular patterns in which the bonding materials are applied, or because of the bonding material penetrating much less on one side of the web than on the other, the bonding material in one surface is substantially unconnected to the bonding material in the other surface. Disposing the bonding material on both sides of the web without complete penetration of the bonding material through the web or connection of bonding material from one side with that of the other enables the development of greater bulk increase from equal amounts of controlled pattern creping and greater strength than obtainable with the same amount of bonding material applied from one side only and completely penetrating the web. The web may be treated prior to application of the bonding material to reduce the interfiber bonding of the lignocellulosic fibers created by papermaking bonds.

In forming the paper web of the present invention, paper fibers may be combined in layers to form a stratified web. When forming a stratified fiber furnish, layers of two or more fiber types may be combined into the final web. In fact, in some embodiments, different types of pulps would be desirable so as to cause the final product to exhibit qualities of both types of pulp.

Various processes may be utilized for forming the webs of the present invention. For example, both wet-laid and air-laid may be employed. An exemplary wet-laid process is shown in FIG. 1 to produce pulp-containing webs. A dilute aqueous suspension of papermaking fibers is usually deposited from a headbox 10 onto an endless traveling forming fabric 26, suitably supported and driven by rolls 28 and 30. Once retained on fabric 26, the fibrous suspension passes water through the fabric as shown by the arrow and may be pulled from the suspension by various vacuums 36. Water removal may also be achieved by combinations of gravity, centrifugal force, and vacuum suction, depending on the particular forming configuration. Forming paper-containing webs is described and is well known in the art.

The cellulosic-based, pulp fibers, used in the present invention may be woody and/or non-woody plant fiber pulps. The pulp may be a mixture of different types and/or qualities of pulp fibers, or, alternatively, one type or grade of pulp may comprise 100 percent of each pulp fiber layer. For example, a pulp containing both low-average fiber length pulp and high-average fiber length pulp (e.g., virgin softwood pulp) may be used.

Low-average fiber length pulp may be characterized as having an average fiber length of less than about 1.2 mm, usually from about 0.7 mm to about 1.2 mm. High-average fiber length pulp may be characterized as having an average fiber length of greater than about 1.5 mm, usually from about 1.5 mm to about 6 mm.

Low-average fiber length pulp may be certain grades of virgin hardwood pulp and low-quality secondary (i.e., recycled) fiber pulp from sources such as, for example, newsprint, reclaimed paperboard, and office waste. High-average fiber length pulp may be bleached and/or unbleached virgin softwood pulps.

Wood pulps of long, flexible fibers that have a low coarseness index are useful for the cellulosic surface layers of the present invention. Illustrative examples of suitable pulps include southern pines, northern softwood kraft pulps, red cedar, hemlock, eucalyptus, black spruce and mixtures thereof. Exemplary commercially available long pulp fibers suitable for the present invention include those available from Kimberly-Clark Corporation under the trade designations "Longlac-19," "Coosa River-54," "Pictou", "Coosa River-56," and "Coosa River-5," as well as those available from other companies under the names "Frazier" and "Crofton" which are northern softwood Kraft pulps.

The pulp fibers used in the present invention may be unrefined or may be beaten to various degrees of refinement. Debonding agents may also be added to reduce the degree of hydrogen bonding if a very open or loose nonwoven pulp fiber web is desired. One exemplary debonding agent is available from the Quaker Chemical Company of Conshohocken, Pennsylvania, under the trade designation "Quaker 2008." Another debonding agent that could be employed is "Witco PA801" which is available from Witco Corporation.

The web may comprise principally lignocellulosic fibers like the described wood pulp or cotton linters used in papermaking which are short fibers of less than one-fourth inch length. However, the web may be formed with a portion of or all of the fibers being relatively longer fibers and still retain advantages of the present invention. Examples of such relatively longer fibers are cotton, wool, rayon, regenerated cellulose, cellulose ester fibers such as cellulose acetate fibers, polyamide fibers, acrylic fibers, polyester fibers, vinyl fibers, protein fibers, fluorocarbon fibers, dinitrile fibers, nitrile fibers, and others, natural or synthetic. The length of these other fibers may be up to about two and one-half inches long, although shorter lengths may be advantageous in forming the web on conventional papermaking equipment. The web may also be dry-formed such as on conventional air-lay equipment using a combination of papermaking fibers and relatively longer synthetic fibers, or either alone. It is particularly advantageous for economic and other reasons to use at least 50 percent papermaking fibers. And it is also particularly advantageous for the fibers to be randomly oriented rather than aligned.

The pulp-containing webs may also contain a minor amount of hydrophilic synthetic fibers, e.g., rayon fibers and ethylene vinyl alcohol copolymer fibers, and hydrophobic synthetic fibers, e.g., polyolefin fibers. The cellulosic web may have a basis weight of between about 10 pounds per ream ("lb/R") and about 60 lb/R, and may, more specifically, between about 25 lb/R and about 60 lb/R.

Web 19 formed by the papermaking process described may be dried according to known means. In particular, a non-compressive drying process may be used. In particular, the dryer shown in U.S. Pat. No. 3,432,936, which is incorporated herein in its entirety by reference thereto, exhibits a dryer that removes moisture from a web by passing air through the web to evaporate the moisture without applying any mechanical pressure to the web. A known through-dryer apparatus may be used having an outer rotatable cylinder with perforations in combination with an outer hood for receiving hot air blown through the perforations. A through-dryer belt carries the material to be dried over the upper portion of the through-dryer outer cylinder. Heated air forced through the perforations in the outer cylinder of the through-dryer removes water from the web. The temperature of the air forced through the web by the through-dryer may range from about 200° to about 500° F. Other useful through-drying methods and apparatus may be found in, for example, U.S. Pat. Nos. 2,666,369 and 3,821,068, both of which are incorporated in their entireties herein by reference.

From forming fabric 26, a formed web 19 may be transferred to a second fabric 40, which may be either a wire or a felt. Fabric 40 is supported for movement around a continuous path by a plurality of guide rolls 42. Also included is a pick up roll 44 designed to facilitate transfer of web 19 from fabric 26 to fabric 40. The speed at which fabric 40 is driven may be slower than the speed at which fabric 26 is driven. This allows for a rush transfer process to add stretch characteristics to the product. When utilized, rush transfer may provide sufficient stretch so that initial creping of the web prior to bonding may be unnecessary (although it may optionally be performed). Web 19 is removed from fabric 40 by another vacuum roll (not shown) onto another fabric (not shown) for drying.

After such processing, web 19 may then be provided to various drying stations according to any of the known drying processes. At this point, regardless of the particular apparatus or process utilized, a web is formed which can be treated in accordance with the method of the present invention to form a double-bonded, single-bonded, single-creped, or double-creped sheet material.

The web 19 may have a basis weight such that in the finished web product, the basis weight will be between about 20 and about 100 pounds, and more desirably between about 25 and about 60 pounds, per 2880 square feet. This means that the web 19, upon being formed into a base web, may have a basis weight between about 16 and 80 pounds, and more desirably between about 22 and about 45 pounds per 2880 square feet, in practicing some of the various forms of the invention. Sheet products in this general range benefit most from the method of the invention since they are largely used where the features of the invention are important. It is in this range of basis weights where the process is most successful in imparting the desired properties to the invention.

In some instances, the fibers utilized to form web 19 may be treated to reduce their bonding by such means as use of unrefined fibers or addition of synthetic fibers which do not form papermaking bonds. Also, the fibers can be treated with a chemical debonder placed either in the fiber furnish, or applied after formation of the web but prior to drying, such as when the web is carried on the wire 26. Such chemical debonders are commonly used to reduce the number of sites along the individual fibers which are susceptible to interfiber bonding of the type utilized in papermaking. Debonding agents which may be used for this purpose include the cationic debonding agents disclosed in U.S. Pat. No. 3,395,708, which are substances within the class of long chain cationic surfactants, and desirably with at least 12 carbon atoms and at least one alkyl chain, such as fatty dialkyl quaternary amine salts, mono fatty alkyl tertiary amine salts, primary amine salts, and unsaturated fatty alkyl amine salts; the cation-active tertiary amine oxides disclosed in U.S. Pat. No. 2,432,126; and the cation-active amino compounds disclosed in U.S. Pat. No. 2,432,127.

In combination with any of the methods described above, or alone, interfiber bonding strength is further reduced if the web is formed under conditions of reduced pressing while it is wet. That is, the web is not subjected to significant compression between two elements or surfaces until it is substantially dried (for example, at least 80 percent dry) in certain embodiments. Thus, contrary to typical papermaking techniques as disclosed in FIG. 1, wherein a pick-up roll is used to press a felt into engagement with a web on a wire to transfer the web from the wire to the felt, the transfer in this embodiment may be accomplished by the use of air or vacuum or both.

The use of any of these systems accomplishes web transfer without the application of pressure in any substantial amount to the web. Consistent with these systems, the web may not be pressed while wet into engagement with a surface of the Yankee dryer by means such as a pressure roll, a step commonly done on conventional papermaking machines. Rather, drying may be accomplished through the use of air flowing over or through a web as by the transpiration drying process disclosed in U.S. Pat. No. 3,432,936. The fibers forming the web are, therefore, not pressed into intimate engagement with one another while the web is wet, and the number of contact points between fibers is reduced, resulting in a reduction of interfiber bonding strength. Such conditions of reduced pressing are typically maintained until the web is substantially dried so that few interfiber bonds are formed.

The best web softening results are obtained when the fibers in the web are treated with a chemical debonder or when the web is formed under conditions of little or no pressing while it is wet, or when a combination of the above conditions is present. Since bulk and softness are properties which the method of the present invention may be utilized to obtain, it may be desirable to optimize those properties in the web prior in order to enable them to be even further improved.

Figure 2:
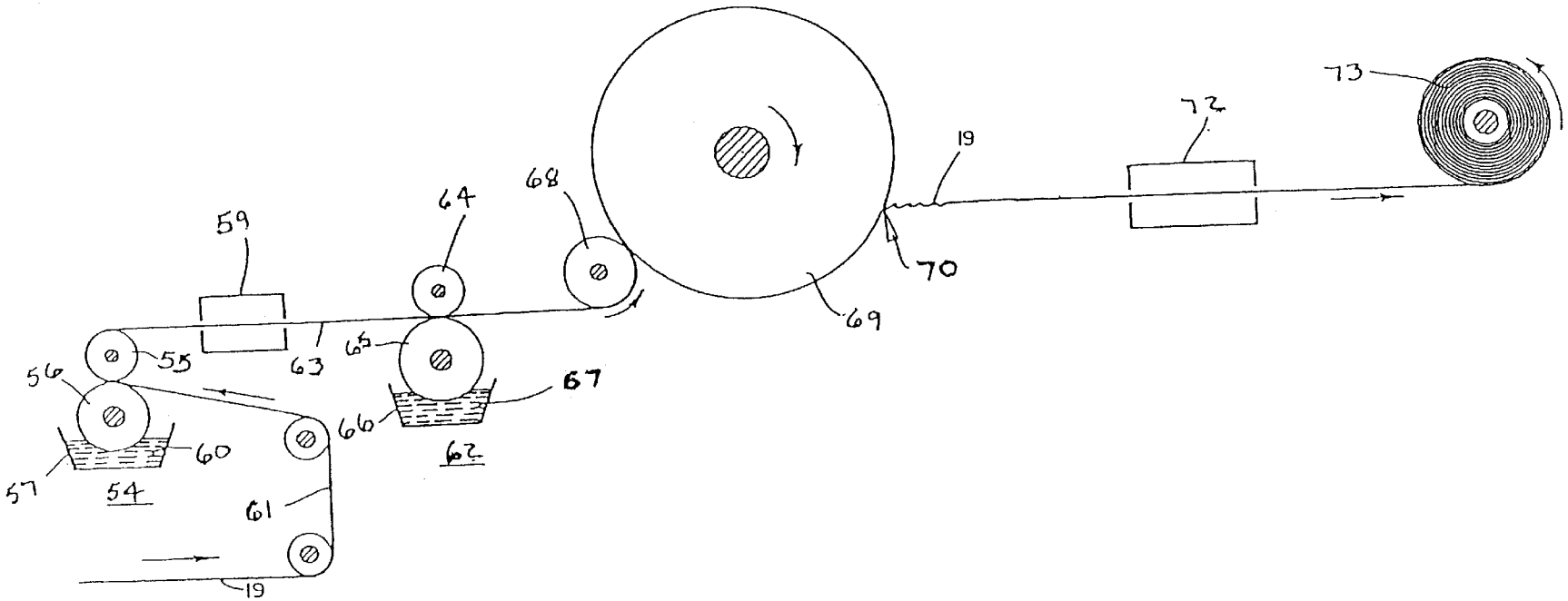
FIG. 2 is a schematic side elevation view of a portion of one form of apparatus for carrying out the method steps of the present invention.

Once paper web 19 is formed, a bonding agent, or material, is applied to one or both surfaces of the web. One or both surfaces may then be pressed to a creping surface with a presser roll, and then creped from the creping surface. FIG. 2 of the present specification illustrates one embodiment of an apparatus that may be used to bond each side and crepe one side of a paper web. Various other permutations of the bonding and creping involved in the present process are also possible.

As shown, web 19 made according to, for example, the process illustrated in FIG. 1, or according to a similar process, is passed through a first bonding-material application station 54. This station 54 includes a nip formed by a smooth rubber press roll 25 and a patterned metal rotogravure roll 56. The lower transverse portion of the rotogravure roll 56 is disposed in a pan 57 containing a first bonding material 60. The rotogravure roll 56 applies an engraved pattern of bonding material 60 to one surface 61 of the web 19 as the web 19 passes through the nip. The web 19 may be passed through a drying station 59 where the adhesive is partially dried or set sufficiently to prevent it from sticking to the press roll in the next bonding-material application station but not so much that it will not stick to the presser roll 68 on the creping surface. The drying station may consist of any form of heating unit well known in the art, such as ovens energized by infrared heat, microwave energy, hot air, etc.

When both sides are to be print bonded, web 19 then passes through a second bonding-material application station 62 where bonding material is applied to the opposite side 63 of the web 19. The second bonding-material application station 62 is illustrated by smooth rubber press roll 64, rotogravure roll 65, and pan 66 containing a second bonding material 67. This bonding material is also applied to the web 19 in a pattern arrangement, although not necessarily in the same pattern as that in which bonding material is applied to the first side 61. Even if the two patterns are the same, it is not necessary to register the two patterns to each other. In addition, the same or different bonding material can be applied at the second bonding material application station 62.

Web 19 is then pressed into adhering contact with the creping drum surface 69 by presser roll 68. Web 19 is carried on the surface of the creping drum 69 for a distance and then removed therefrom by the action of a creping doctor blade 70, which performs a conventional creping operation on the bonded portions of the web 19. That is, it imparts a series of fine fold lines (crepe bars) to the portions of the web 19 which adhere to the creping surface 69. The creping surface 69 can be provided by any form of surface to which the bonding adhesive will tightly adhere to enable creping of the web 19 from the surface 69. The creping surface 69 may be heated to increase the adhesion of the web to the drum and to dry the web. An example of a suitable creping surface is a Yankee dryer.

It has been found that it is important to ensure that the surface of the paper web which will be creped from the creping surface 69 is sufficiently adhered to that creping surface prior to being creped therefrom. Accordingly, it is typical that sufficient bonding agent will be used to ensure sufficient adhesion at the contact surface.

The web 19 is then optionally passed through a curing station 72 to cure the bonding material on both sides of the web 19 if curing is required. The curing station 72 may be of any form known by those skilled in the art, such as those forms described for drying station 59. After passing through the curing or drying station 72, the web 19 is wound into a parent roll 73 by conventional winding means (not shown). It may then be transferred to another location to cut it into commercial size sheets for packaging.

Referring to the apparatus illustrated in FIG. 2, some variation is permissible in the bonding-material application stations. For example, the second application station could be arranged to print the bonding material directly on the creping drum just prior to placing the web 19 into contact with it as long as sufficient time is allowed for the web to pick up sufficient binder to adhere to the creping drum. Other variations could also be practiced as well.

In addition, it is to be understood that the present invention is not limited to any particular print bonding process and any of the print bonding process disclosed by Gentile et al. or by others could utilize the presently inventive print bonding fluid and add-on process.

The pattern of bonding material applied to the web 19 can also be varied so that it can be on either side, and must be on one side, in any form of fine lines or fine areas which leaves a portion of the surface of the web 19 free from bonding material. The pattern may be such that the bonding material occupies between about 15 percent and about 60 percent of the total surface area of the web, leaving between about 40 percent and about 85 percent of each surface of the web free from bonding material in the finished web product. The patterns disclosed in U.S. Pat. Nos. 3,047,444, 3,009,822, 3,059,313 and 3,009,823 may be advantageously employed.

Some migration of bonding material occurs after printing, and the pattern of the rotogravure roll is chosen accordingly. Thus, the bonding material penetrates partially through the web 19 and in all directions of the plane of the web 19. Migration in all directions in the plane of the web may be controlled to leave areas of between about 50 percent and about 75 percent of the finished web surface free from bonding materials.

The bonding material utilized in the process and product of the form of the present invention should be capable of several functions, one being the ability to bond fibers in the web to one another and the other being the ability to adhere the bonded portions of the web to the surface of the creping drum.

"In general, any material having these two capabilities may be utilized as the standard bonding material, preferably if the material can be dried or cured to set it. Among the bonding materials which are capable of accomplishing both of these functions and which can be successfully used are urethane latex emulsions, styrene-butadiene emulsions, vinylchloride emulsions, acrylate latex rubber emulsions, useful on unheated as well as heated creping surfaces; emulsions of resins such as acrylates, vinyl acetates, and methacrylates, all of which are useful on a heated creping surface; and water soluble resins such as carboxy methyl celluloses, polyvinyl alcohols, and polyacrylamides."

In one embodiment, the standard bonding agent used in the process of the present invention comprises an ethylene vinyl acetate copolymer. In particular, the ethylene vinyl acetate copolymer is cross-linked with N-methylol acrylamide groups using an acid catalyst. Suitable acid catalysts include ammonium chloride, citric acid, and maleic acid. The bonding agent may have a glass transition temperature of not lower than −30° C. and not higher than +10° C.

However, in other instances, the bonding material may comprise a mixture of several materials, one having the ability to accomplish interfiber bonding and the other being utilized to create adherence of the web to the creping surface 69. In either instance, the materials may be applied as an integral mixture to the same areas of the web.

Such materials may also comprise any of the materials listed above, mixed with a low molecular weight starch, such as dextrin, or low molecular weight resin such as carboxy methyl cellulose or polyvinyl alcohol. It should be noted here that when practicing the form of the invention which does not require two controlled pattern crepes, one of the bonding materials can be chosen for its ability to bond fibers together and another can be chosen for its ability to adhere to the creping surface or presser roll 68.

In forming one product of the present invention, elastomeric bonding materials are employed which are basically materials capable of at least 75 percent elongation without rupture. Such materials generally should have a Young's modulus by stretching which is less than 25,000 psi. Typical materials may be of the butadiene acrylonitrile type, or other natural or synthetic rubber latices or dispersions thereof with elastomeric properties, such as butadiene-styrene, vinyl copolymers, or vinyl ethylene terpolymer. The elastomeric properties may be improved by the addition of suitable plasticizers with the resin.

In all instances of the present invention, an additive comprising a water-borne epoxy resin, a water-borne urethane resin, or both, is utilized as part of the bonding material. As a matter of definition, water-borne epoxy resins and urethane resins must be dispersible in a water-based emulsion system. Utilization of such resins allows the amount of standard bonding agents used in the process to be reduced. This serves to reduce the costs associated with such processes. In addition, the use of such resins also counteracts some of the foaming that often takes places during the print-bonding processes caused by air entrainment in recirculating binder systems. Moreover, these resins, because they reduce the amount of standard bonding agents, such as EVA, act to reduce some of the odors often associated with these types of processes.

Epoxy resins dispersions are generally formaldehyde-free waterborne polymers that have, in the past, been utilized in a number of various end uses. Such epoxy resins have, as described above, even been used as binders in the non-woven and textile industries. However, it is believed that prior to the present invention, the particular water-borne epoxy and urethane resins have not been utilized in the context of a print bonding material for paper-containing webs.

The chemical structure of a typical epoxy resin is as follows:

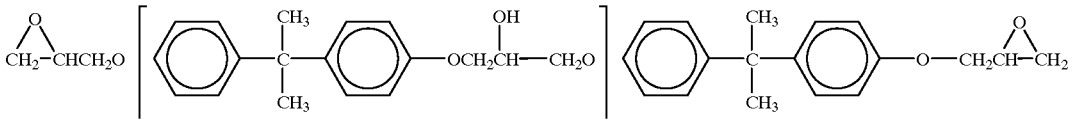

The backbone length of this particular molecule can be varied and various reactive diluents can be added to produce resins ranging from low viscosity liquids of 5 to 10 poise to friable solids with molecular weights from less than 500 to greater than 3000. Various multifunctional epoxy resins where more than two reactive groups are present per molecule may also be utilized in the present invention. Such multifunctional resins provide higher crosslinked matrices leading to improved heat and chemical resistance.

Water-borne epoxy and urethane resin dispersions may generally be cured in much the same way as conventional epoxies and urethanes are cured. One major difference is that the curing agent, when utilized, may be incorporated into the water dispersion itself. The curing agents utilized are water soluble, or dispersible, and are stable in the aqueous medium. Typical curing agents (sometimes referred to as "initiators") utilizable with the present epoxy resins include aliphatic amine adducts, modified cycloaliphatic amines, accelerated amido-amines, polymeric amido-amines, and modified polyamido-amines available under the designation curing agents from Shell Chemical Company and under various designations from others. Specific examples of such initiators include dicyandiamides, substituted imidazoles, aliphatic and aromatic amines and including tertiary amines. Various curing agents are available from vendors such as Shell Chemical under the designations "EPI-CURE Curing Agent" "3295", "3370", "3072", "3140", and "8535-W-50".

The fact that the epoxy resins are in an aqueous dispersion renders the resin compatible with materials that have historically not been compatible. For example, the water-borne epoxy resins can be used successfully with conventional latex emulsions, including acrylic, urethane, styrene-butadiene, vinyl chloride, and polyvinyl acetate emulsions.

The particular water-borne epoxy resins that may be utilized include various aqueous dispersions of epoxies such as bisphenol A epoxy resin, butadiene-acrylonitrile polymer modified epoxy resin, and epoxidized o-cresylic novolac resin. A bisphenol A epoxy resin is available from Shell Chemical Company under the designation EPI-REZ 351 5-W-60 Resin (formerly EPI-REZ W60-3515 Epoxy Resin Dispersion); a butadiene-acrylonitrile polymer modified epoxy resin is available from Shell Chemical Company under the designation EPI-REZ 3519-W-50; and an epoxidized o-cresylic novolac resin is available from Shell Chemical Company under the designation EPI-REZ 6006-W-70.

Water-borne urethanes, which act like the epoxies discussed herein, are also applicable for use as the present print bonding fluid additives. Typically, the urethanes will be more resistant to acids than epoxies, but the epoxy resins will result in a harder adhesive coating on the wiper products.

Typically, amounts of the epoxy and/or urethane resins included in the print bonding fluids of the present invention will be in the range of 15 percent or less (based on the amount by weight of active solids of the resins to the total dried binder solids in the fluid). Desirably, the resins will be present in an amount of from about 5 percent to about 15 percent, and even more desirably from about 5 percent to about 11 percent. Obviously, the exact amount of resins employed will depend on the particular characteristics desired in the web.

The total amount of bonding material applied to the webs can be varied over a wide range while still realizing many of the benefits of the invention. However, when the products of the present invention are absorbent wiper products, it is desirable to keep the amount of bonding material to a minimum. In addition, the standard bonding agents, such as ethylene vinyl acetate, themselves should be kept at the lowest levels possible in order to achieve the advantages referred to above. The amount of total print bonding material that will typically be employed in the webs of the present invention will be from about 3 percent to about 20 percent, based on dry fiber weight of the finished web product. Generally, from about 7 to about 12 percent may be desired.

The creping drum 69 may in some instances comprise a heated pressure vessel such as a Yankee dryer or, in other instances, may be a smaller roll and may be unheated. The necessity for heating depends upon both the characteristics of the particular bonding material employed and the moisture level in the web. Thus, the bonding material may require drying or curing by heating in which case the creping drum may provide a convenient means to accomplish this. Alternatively, the moisture level of the web being fed to the creping drum may be higher than desired, and the creping drum may be heated to evaporate some of this moisture. Some bonding material may not require the curing step effected by the curing station 72.

It is desired that the bonding material migrate through only a minor portion of the thickness of the web. It is important that when soft, bulky, absorbent products are desired, the bonding materials which create the strong surface regions should not generally extend all the way through the web, whether it is bonding material from one surface of the web extending through to the other surface, or bonding material from one surface extending into contact with bonding material from the other surface. It is the portions of the web which do not have the bonding material applied in the steps of the invention that are most greatly affected by the controlled pattern creping to form the soft, absorbent central core region. The best way to assure that excessive penetration of the bonding material does not occur is to limit penetration of the bonding material on either side of the web to no more than about 40 percent through the thickness of the finished web product. Typically, the bonding material extends less than about 30 percent through the thickness of the web. In some embodiments, the penetration of the bonding material on one side of the web may be more than 40 percent and up to 60 percent, as long as the penetration of the bonding material on the other side of the web is not so great as to interconnect the bonding materials from both sides of the web.

However, it is also desired that in order to obtain soft, bulky products, the bonding material penetrate a significant distance into the web from the surface to at least 10 percent of the web's thickness, and more desirably to at least 40 percent. This degree of penetration will assure creation of the softness and bulkiness in the surface regions as described above.

Migration and penetration of the bonding material is influenced, and thus can be controlled, by varying the basis weight of the web itself and by varying the pressure applied to the web during application of the bonding material thereto, since wicking through the web is enhanced when the fibers are compacted closely together. Also, changing the nature of the bonding material and its viscosity will affect migration and penetration of the bonding material. In addition, varying the amount of time between application of the bonding material and setting or curing of the material will affect penetration, as well as varying base web moisture content and pressure roll loading at the dryer. A determination of the exact required conditions is easily within the skill of a papermaker without undue experimentation once the particular standard bonding material and amount of penetration is chosen.

At occasional locations, some of the bonding material will penetrate further or less than desired due to inherent process and base web deviations. The desired ranges of bonding material penetration and migration expressed herein, therefore, refer only to the great majority of the web and does not preclude the possibility of occasional variances. It may even be desirable in some cases, to purposefully cause deeper penetration of the bonding material at selected locations occupying less than about 10 percent of the surface area of the finished web to tie the surfaces of the web together without unduly diminishing the absorbency and bulk of the central core region. Such deeper penetrations can be caused by deeper engraved lines or dots at spaced locations on the rotogravure roll. Such practices are to be considered within the scope of the invention.

Specifically, according to the present invention, the bonding agent (including the present resin additives) is applied to each side of the layered paper web so as to cover up to about 55 percent of the surface area of the web. More particularly, in most applications, the bonding agent will cover up to about 50 percent of the surface area of each side of the web and sometimes up to only about 35 percent. The total amount of bonding agent applied to of the web will typically be in the range of from about 4 percent to about 20 percent by weight, based upon the total weight of the web. In other words, the bonding agent is applied to each side of the web at an add-on rate of about 2 percent to about 10 percent by weight.

At the above amounts, the bonding agent can penetrate the paper web from about 20 percent to about 40 percent of the total thickness of the web. In most applications, the bonding agent may not penetrate over 50 percent of the web but should at least penetrate from about 10 percent to about 15 percent of the thickness of the web, and most desirably at least about 40 percent.

A number of various printing rollers may be utilized in applying the bonding material to the surface(s) of the web. For example, typical examples of suitable printers are direct and offset gravure printers or coaters. The offset gravure coater has the advantage of allowing better control over the amount of adhesive composition applied, especially when low levels of bonding material are desired. In either the direct or offset methods, the bonding material is picked up by an etched or engraved gravure or furnish roll. In the direct gravure coater, the bonding material is transferred directly to a surface of the web. In the offset gravure coater, the bonding material is transferred to a rubber-covered application or offset roll which in turn transfers the bonding material to a surface of the web. Alternatively, a knurled roll could be installed between the furnish roll and the offset roll and both the furnish roll and the offset roll would be rubber-covered. The surface area and depth of the recesses in the knurled roll determine the amount of bonding material that is transferred to a surface of the web.

A "double depth" gravure roll pattern with two depths of cells has been previously disclosed in U.S. patent application serial Nos. 08/484,591 and 09/039,933, both filed Jun. 7, 1995. Both of these patent applications are incorporated herein in their entireties by reference.

The bonding agent is applied to the base web as described above in a preselected pattern. In one embodiment, for instance, the bonding agent can be applied to the web in a reticular pattern, such that the pattern is interconnected forming a net-like design on the surface.

In one embodiment, the bonding agent is applied to the web in a pattern that represents a succession of discrete dots. Applying the bonding agent in discrete shapes, such as dots, provides sufficient strength to the web without covering a substantial portion of the surface area of the web. In particular, applying the bonding agents continuously to the surfaces of the web may adversely affect the web. Thus, it is often desirable to minimize the amount of bonding agent applied.

Other patterns such as spirally cut grooves, square pegs, diamonds, various logos, and the like are also useful for applying the bonding materials of the present invention. In addition, in certain circumstances, a smooth furnish roll could be employed to apply the bonding material.

After being dried and then wound into a rolled material, the wiping product of the present invention can then be transferred to another location and cut into commercial size sheets for packaging as a wiping product.

The use of the water-borne epoxies and water-borne urethanes in conjunction with standard bonding materials in the presently inventive print bonding fluids results in a product exhibiting sufficient strength to function as an absorbent product.

In addition, a reduction in the amount of standard print bonding adhesives, such as EVA, also results in a reduction in the amount of unwanted odors emanating from the forming process. In addition to the odor of EVA, various amines produced as by-products during the curing process may also create undesirable odors.

As previously mentioned, the use of the additives also results in a decreased need for expensive defoaming agents during the process. Foaming is typically a problem in forming such webs because of the use of various systems that apply binders at speeds of up to 3000 ft/min. Recirculating systems recycle excess binder solutions by scraping such excesses from the rollers and from the webs themselves. The excess solution goes into recirculation tanks whereupon the solution is then pumped through a filter back to the binder solution container for application to the web.

Employment of the present urethane and epoxy additives in print bonding fluids also allow characteristic control over various products. For example, the resin additive may be used to impart solvent resistance to products, such as wipers as opposed to paper towels, when desired. In addition, use of the present print bonding additives may reduce the tendency of the binder to leave a residual film on surfaces wiped with a saturated wiper.

Although desired embodiment of the invention has been described using specific terms, devices, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A process for forming a paper-based sheet material comprising the steps of:

a) providing a web containing paper fibers, said web having a first surface and a second surface;

b) applying a first bonding material in a spaced-apart pattern arrangement to said first surface of said web, said first bonding material being applied to said first surface to penetrate said web sufficiently to form bonded web portions in which said fibers are bonded together by said first bonding material, said first bonding material comprising a standard bonding material and a water-borne composition chosen from the group consisting of water-borne epoxies, and mixtures of water-borne urethanes and water-borne epoxies;

c) adhering said first surface of said web to a creping surface and then creping said web from said creping surface.

2. The process of claim 1 further comprising the step of applying a second bonding material in a spaced-apart pattern arrangement to said second surface of said web, said second bonding material being applied to said second surface to penetrate said web sufficiently to form bonded web portions in which said fibers are bonded together by said second bonding material, said second bonding material comprising a standard bonding material.

3. The process of claim 2 wherein said second bonding material further comprises a water-borne composition chosen from the group consisting of water-borne epoxies, and mixtures of water-borne urethanes and water-borne epoxies.

4. The process of claim 2 further comprising the step of adhering said second surface of said web to a creping surface and then creping said web from said creping surface.

5. The process of claim 1 further comprising the step of applying a second bonding material in a spaced-apart pattern arrangement to said second surface of said web, said second bonding material being applied to said second surface to penetrate said web sufficiently to form bonded web portions in which said fibers are bonded together by said second bonding material, said second bonding material comprising a standard bonding material and further comprising the step of adhering said second surface of said web to a creping surface and then creping said web from said creping surface.

6. The process of claim 5 wherein said second bonding material further comprises a water-borne composition chosen from the group consisting of water-borne epoxies, and mixtures of water-borne urethanes and water-borne epoxies.

7. The process of claim 1 wherein said standard bonding material comprises an ethylene vinyl acetate copolymer.

8. The process of claim 1 wherein said standard bonding material comprises a material chosen from the group consisting of urethane latex emulsions, styrene-butadiene emulsions, vinylchloride emulsions, acrylate emulsions, vinyl acetate emulsions, methacrylate emulsions, carboxymethyl cellulose resins, polyvinyl alcohol resins, and polyacrylamide resins.

9. The process of claim 1 wherein said water-borne epoxies comprise an epoxy chosen form the group consisting of bisphenol A epoxy resin, butadiene-acrylonitrile polymer modified epoxy resin, and epoxidized o-cresylic novolac resin.

10. The process of claim 5 wherein said water-borne epoxies comprise an epoxy chosen form the group consisting of bisphenol A epoxy resin, butadiene-acrylonitrile polymer modified epoxy resin, and epoxidized o-cresylic novolac resin.

* * * * *